US011459859B2

(12) United States Patent
Branting

(10) Patent No.: US 11,459,859 B2
(45) Date of Patent: Oct. 4, 2022

(54) MULTI-STAGE DOWNHOLE GAS SEPARATOR

(71) Applicant: PRODUCTION PROS LLC, Brighton, CO (US)

(72) Inventor: Russell Branting, Brighton, CO (US)

(73) Assignee: PRODUCTION PROS LLC, Brighton, CO (US)

( * ) Notice: Subject to any disclaimer, the term of this patent is extended or adjusted under 35 U.S.C. 154(b) by 71 days.

(21) Appl. No.: 16/848,493

(22) Filed: Apr. 14, 2020

(65) Prior Publication Data

US 2021/0317735 A1 Oct. 14, 2021

(51) Int. Cl.

| | |
|---|---|
| ***E21B 43/38*** | (2006.01) |
| ***E21B 23/12*** | (2006.01) |
| ***E21B 34/08*** | (2006.01) |
| ***E21B 43/12*** | (2006.01) |

(52) U.S. Cl.

CPC ..... *E21B 43/121* (2013.01); *E21B 23/12* (2020.05); *E21B 34/08* (2013.01); *E21B 43/38* (2013.01)

(58) Field of Classification Search

CPC ..... E21B 43/38; E21B 43/121; E21B 23/12; E21B 34/08; E21B 23/127

See application file for complete search history.

(56) References Cited

U.S. PATENT DOCUMENTS

| | | | | |
|---|---|---|---|---|
| 2,104,339 | A * | 1/1938 | Arutunoff | E21B 43/38 166/105.1 |
| 3,128,719 | A * | 4/1964 | Jongbloed | E21B 43/38 166/105.5 |
| 3,643,740 | A * | 2/1972 | Kelley | E21B 43/127 166/265 |
| 4,241,788 | A * | 12/1980 | Brennan | E21B 43/38 166/105.5 |
| 5,653,286 | A * | 8/1997 | McCoy | E21B 43/38 166/105.5 |
| 6,179,054 | B1 * | 1/2001 | Stewart | E21B 43/121 166/105.5 |
| 6,481,499 | B2 * | 11/2002 | Lopes | E21B 43/38 166/105.5 |
| 6,494,258 | B1 | 12/2002 | Weingarten | |
| 7,377,314 | B2 | 5/2008 | Gonzalez | |
| 9,045,979 | B2 | 6/2015 | Cobb et al. | |
| 9,771,786 | B2 * | 9/2017 | Raglin | E21B 43/38 |
| 2010/0147514 | A1 * | 6/2010 | Swaringin | E21B 43/38 166/265 |
| 2017/0138166 | A1 * | 5/2017 | Wang | B01D 19/0042 |
| 2018/0223642 | A1 * | 8/2018 | Zahran | E21B 43/08 |

* cited by examiner

*Primary Examiner* — Michael R Wills, III
(74) *Attorney, Agent, or Firm* — Holzer Patel Drennan

(57) ABSTRACT

Horizontal wells and multi-completion vertical wells generally have a greater performance requirement on downhole gas separators to separate a gas portion from a liquid portion of the well fluid prior to entering an artificial lifting system (or pump). Implementations described and claimed herein provide a downhole gas separator comprising a dip tube extending from a tubing inlet to an open end, a tubing section extending around the dip tube, and a separator sleeve extending around the tubing section. A liquid component of the fluid stream makes a first u-turn at the open end of the separator sleeve, an s-turn at the openings in the tubing section, and second u-turn at the open end of the dip tube. A gaseous component of the fluid stream continues upwards at the open end of the separator sleeve.

20 Claims, 4 Drawing Sheets

MULTI-STAGE DOWNHOLE GAS SEPARATOR

BACKGROUND

Downhole gas separators (also referred to as "anchors" or "separators") are tubular, perforated devices attached to the bottom of a production tubing string that helps to prevent gas interference on a downhole artificial lift system (e.g., a downhole rod pump or a sucker-rod pump). Generally, separators work on the principle that gasses, being lighter than liquids, rise with reference to the liquids. As production well fluids enter a separator, the gas separates from the liquid and exits from the separator through openings near the top of the separator. The remaining production fluids enter the artificial lift system through a dip tube (a tube within the separator), which has an opening near the bottom. As a result, much of the gas escapes before the fluid enters the artificial lift system.

In vertical wells, the downhole gas separator and corresponding artificial list system are often located within the well bore below well fluid generating perforations in an effort to provide a first level of gas/liquid separation that biases a gaseous portion of the well fluid to move upward and away from an inlet to the artificial lift system due to density differences and a liquid portion of the well fluid to move downward toward the inlet of the artificial lift system. In horizontal wells (and vertical wells with multiple completion intervals), it is not possible to position the downhole gas separator and corresponding artificial lift system below the well fluid generating perforations as the well fluid generating perforations constitute the lowest portion of the well bore. Further, modern horizontal wells generate a much greater volume of well fluid than a traditional vertical well. As a result, horizontal wells typically have a greater performance requirement on downhole gas separators to separate a gaseous portion from a liquid portion of the well fluid prior to entering the artificial lift system.

SUMMARY

Implementations described and claimed herein address the foregoing problems by providing a downhole gas separator comprising a dip tube extending from a tubing inlet to an open end, a tubing section extending around the dip tube, and a separator sleeve extending around the tubing section, which may incorporate mechanical separation. The tubing section has a closed end below the open end of the dip tube and openings above the open end of the dip tube. The separator sleeve has a closed end below the openings in the tubing section and an open end above the openings in the tubing section.

Other implementations are also described and recited herein.

BRIEF DESCRIPTIONS OF THE DRAWINGS

DETAILED DESCRIPTIONS

Figure 1:
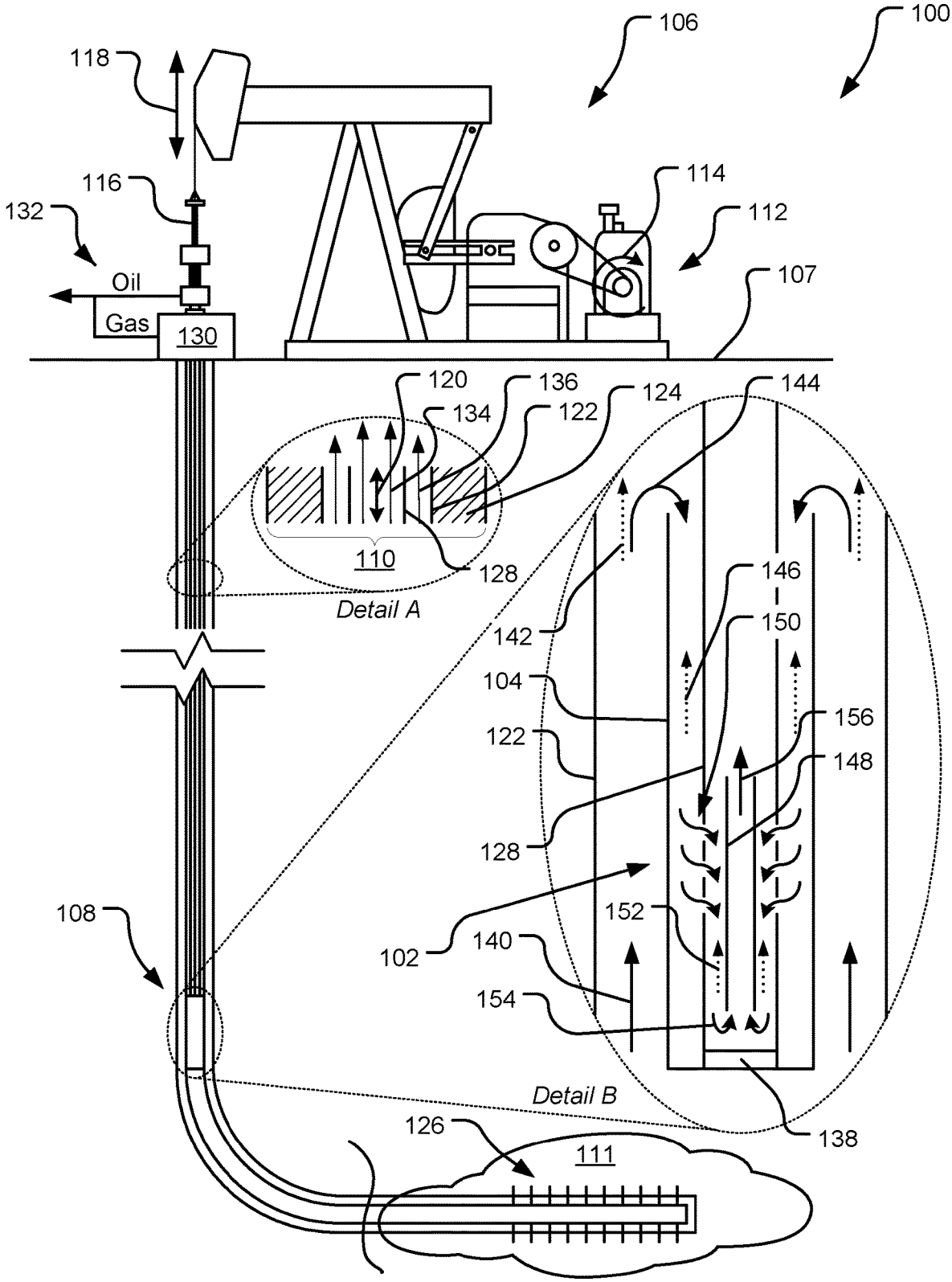
FIG. 1 illustrates an example oil well incorporating a downhole gas separator with a separator sleeve.

FIG. 1 illustrates an example oil well 100 incorporating a downhole gas separator 102 with a separator sleeve 104. The oil well 100 includes a pumpjack 106 mounted on ground surface 107. The pumpjack 106 is an over-ground drive for a reciprocating piston pump 108 (also referred to herein as a sucker-rod pump, or simply a pump) oriented within a wellbore 110 of the oil well 100 and used to mechanically lift liquid (e.g., oil and/or water) from an subterranean oil production zone 111. The depicted beam-type pumpjack 106 (also referred to as a walking beam) converts rotary motion of a motor 112 (as illustrated by arrow 114) to reciprocating vertical motion of a polished rod 116 and accompanying sucker rod 120 (as illustrated by arrow 118) and a pumped fluid load. Other types of pumps are contemplated herein in place of the reciprocating piston pump 108, as well as other types of drives for the reciprocating piston pump 108 are contemplated herein in place of pumpjack 106. All downhole artificial lift systems are encompassed herein as pumps.

Wellbore 110 is first drilled into the production zone 111. Casing 122 is placed within the wellbore 110 and an annulus between the outside of the casing 122 and the wellbore 110 is filled with cement 124 to provides structural integrity to the wellbore 110 and seal the casing 122 in place within the wellbore 110. After drilling and casing the well 100, small holes called perforations 126 are shot through the casing 122 and cement 124 and into the surrounding rock of the production zone 111 to provide a path for a production fluid stream (e.g., oil, gas, and water) to flow from the surrounding rock into the casing 122. The section of the casing 122 where the perforations 126 are present is referred to herein as a perforated area.

Tubing 128, including the separator sleeve 104, and with dip tube 148 attached at its distal end at a mechanical seating nipple is extended into the casing 122 and connected back to the surface 107 at a surface casing 130. The pump 108 is extended into the tubing 128 and seated at the mechanical seating nipple. The pump 108, which is oriented within the tubing 128, is fluidly connected to the dip tube 148 at an inlet for the tubing 128 at the mechanical seating nipple. A manifold 132 at the surface 107 connects the interior of the tubing 128 to an output liquid line (e.g., oil and/or water) and an annulus between the tubing 128 and the casing 122 to a gas line (e.g., natural gas), following which the fluid recovered from the production zone 111 is further processed.

Detail A illustrates a cross-section of the wellbore 110 in production. Sucker rod 120 reciprocates within the tubing 128, thereby driving the pump 108 to pump liquid recovered from the production zone 111 upward within the tubing 128 to the manifold 132 at the surface 107, as illustrated by arrow 134. Further, gasses recovered from the production zone 111 are separated from the liquid prior to entry into the pump 108 and are routed within the annulus between the tubing 128 and the casing 122 and carried to the manifold 132 at the surface 107 via natural pressure of the production zone 111, as illustrated by arrow 136.

As discussed above, efficient and complete separation of liquid and gaseous components of the fluid recovered from the production zone 111 can be difficult, particularly when the pump 108 is oriented above the production zone 111, as is the case in many horizontal wells as illustrated by well 100 of FIG. 1, and also in some vertical wells. Detail B illustrates an example cross-sectional flow path of liquid and gaseous components recovered from the production zone 111 for improved separation prior to entry into the pump 108, which is illustrated in detail in FIGS. 2A and 2B and described below.

A combined fluid stream of multi-phase (liquid and gaseous) components (e.g., oil, water, and/or natural gas) of the fluid recovered from the production zone 111 is pumped (and perhaps pushed via natural pressure of the production zone 111) upward between the casing 122 and the separator sleeve 104, as illustrated by arrow 140. A bottom end of the separator sleeve 104 is welded or otherwise sealed to a bottom of the tubing 128, which is also sealed at its bottom with a bullplug 138 or other sealing structure. A top end of the separator sleeve 104 is left open to a first annulus between the casing 122 and the tubing 128 above the pump 108, dependent upon the pump 108 length.

The combined stream of liquid and gaseous components has a first diversion point at the separator sleeve 104 opening, where the gaseous components are biased to continue moving upwards due to their lower relative fluid density and upward momentum, as illustrated by dotted arrow 142, while the liquid components are biased to make a u-turn (i.e., a 180-degree turn) and continue within a second annulus between the separator sleeve 104 and the tubing 128 due to the pumping pressure caused by the pump 108, as illustrated by solid arrow 144.

The fluid stream flowing downward between the separator sleeve 104 and the tubing 128 will still include some of the gaseous components mixed therein as the fluid stream approaches a second diversion point at a series of openings in the tubing 128 inside of the separator sleeve 104. The gaseous components are still biased to move against the overall downward fluid flow due to their lower relative fluid density, as illustrated by dotted arrow 146, while the liquid components are biased to make an s-turn (i.e., a series of two opposite 90-degree turns) and continue within a third annulus between the tubing 128 and a dip tube 148 still due to the pumping pressure caused by the pump 108, as illustrated by solid arrows 150.

The dip tube 148 has an open end extending below the openings in the tubing 128 and serves as an inlet for the pump 108. In other implementations, the dip tube 148 includes openings similar to that of the tubing 128 (see e.g., openings 382 of FIG. 3 and detailed description thereof). The fluid stream flowing downward between the tubing 128 and the dip tube 148 will still include some of the gaseous components mixed therein as the fluid stream approaches a third diversion point at the open end of the dip tube 148. The gaseous components are still biased to move against the overall downward fluid flow due to their lower relative fluid density, as illustrated by dotted arrow 152, while the liquid components are biased to make a second u-turn and continue into the dip tube 148 due to the pumping pressure caused by the pump 108, as illustrated by solid arrow 154.

As the fluid drawn into the dip tube 148 has had three separate points of diversion and associated opportunities for the gaseous components to separate from the liquid components of the initial combined stream, the fluid drawn into the dip tube 148 is substantially comprised of the liquid components as it enters the pump 108, as illustrated by solid arrow 156. Further, as the reciprocating piston pump 108 by its very nature has discrete and separate upstroke and downstrokes, during the downstroke, the gaseous components may have an additional opportunity to separate from the liquid components of the combined stream and rise due to their lower respective densities as the downward flow of the combined stream caused by the pump 108 subsides. Still further, one or more of the separator sleeve 104, the tubing 128, and the dip tube 148 may include structures to mechanically facilitate separation of the gaseous components from the liquid components (not shown, see e.g., separation structures 368 of FIG. 3). The multiple separate points of diversion and associated opportunities for the gaseous components to separate from the liquid components is also referred to as multi-stage separation.

The wellbore 110 and structures therein are generally concentric about the sucker rod 120, thus the structures illustrated in Detail A are generally mirrored about sucker rod 120 and the structures illustrated in Detail B are generally mirrored about arrow 156. The disclosed u-turns and s-turns and associated turn degrees are approximate and illustrative of overall changes in fluid direction over a variable distance, not an exact directional change of a specific fluid quantity at any particular point. While the depicted oil well 100 is that of a horizontal well, the downhole gas separator 102 with the separator sleeve 104 may be similarly used in a vertical well.

Figure 2A:
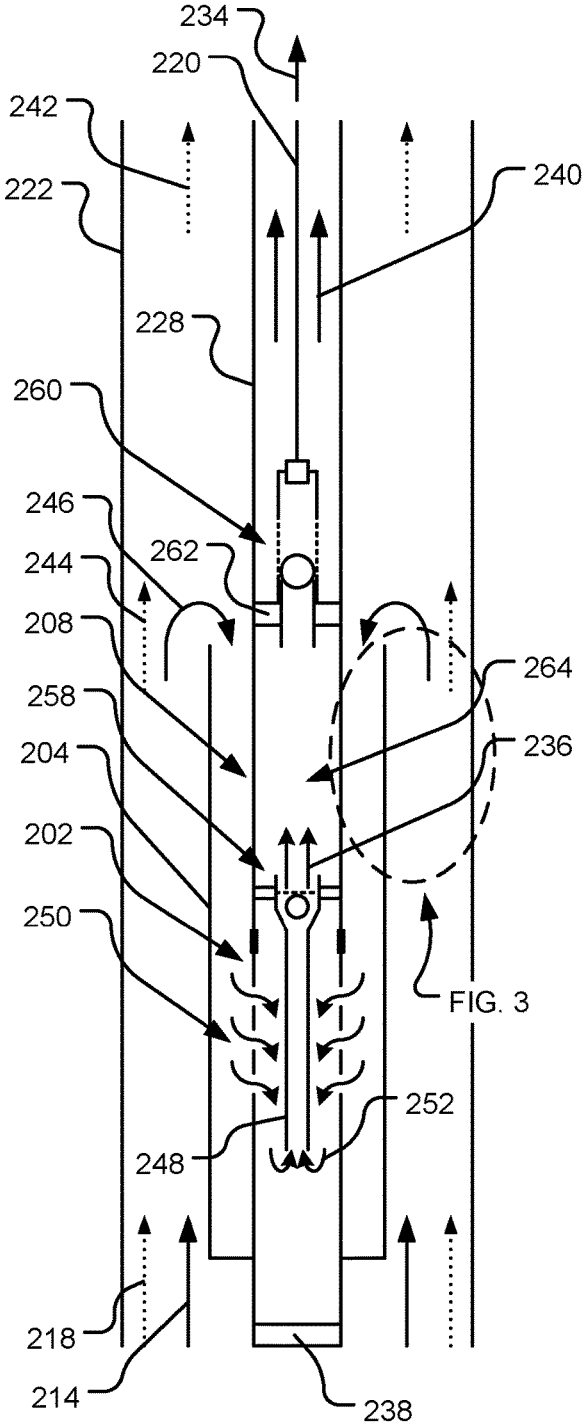
FIG. 2A illustrates an example downhole gas separator with a separator sleeve during an upstroke of a reciprocating piston pump.

FIG. 2A illustrates an example downhole gas separator 202 with a separator sleeve 204 during an upstroke of a reciprocating piston pump 208. The reciprocating piston pump 208 is secured within casing 222 that extends between a subterranean production zone (not shown, see e.g., production zone 111 of FIG. 1) and a manifold (not shown, see e.g., manifold 132 of FIG. 1) at the surface. An output of the reciprocating piston pump 208 within the casing 222 is connected back to the surface with tubing 228. An output of the casing 222 within a first annulus between the casing 222 and the tubing 228 is also connected back to the surface. In various implementations, the tubing 228 is at least 2.5 inches in diameter (e.g., 2.875 inches), which can yield reduced friction loss on the fluid drawn into the tubing 228 as compared to smaller tubing (e.g., 1.5 inches or less).

Figure 2B:
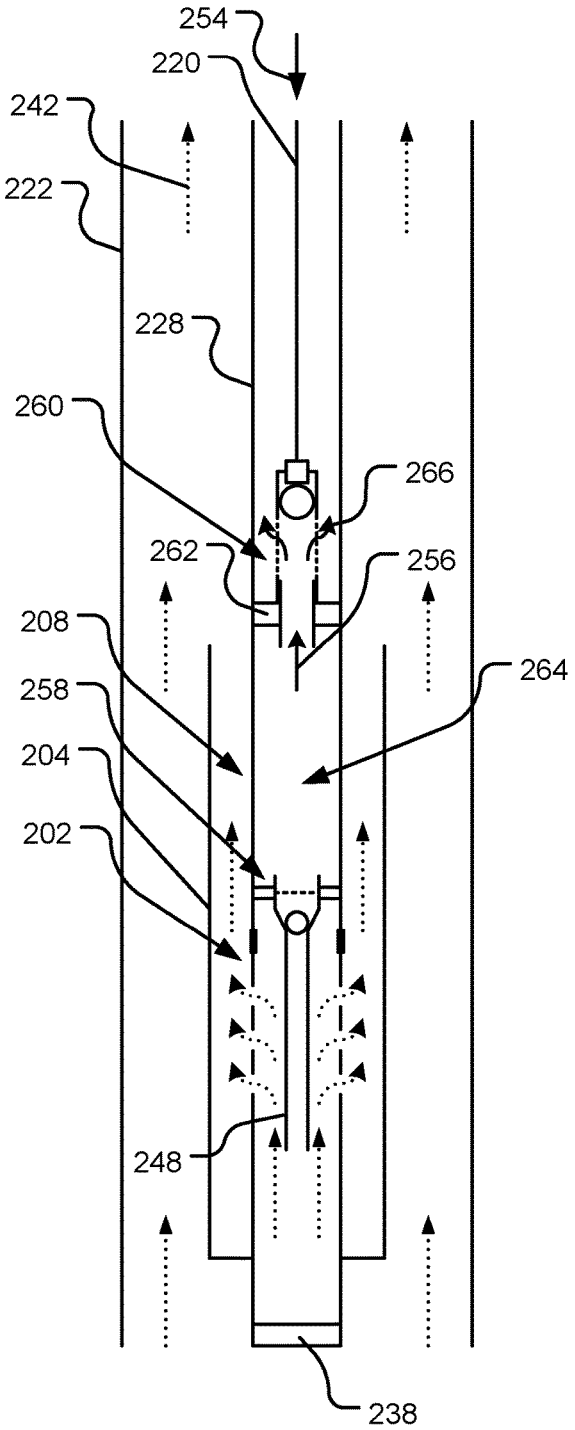
FIG. 2B illustrates the example downhole gas separator of FIG. 2A during a downstroke of the reciprocating piston pump.

For illustration purposes, only a section of the casing 222 is depicted in FIGS. 2A and 2B and it extends in both longitudinal directions beyond the view of FIGS. 2A and 2B between the subterranean production zone and the manifold. Similarly, only a section of the tubing 228 is depicted in FIGS. 2A and 2B illustrates and it extends in one longitudinal direction beyond the view of FIGS. 2A and 2B to the manifold.

As discussed above, efficient and complete separation of liquid and gaseous components of fluid recovered from the production zone can be difficult, particularly when the pump 208 is oriented above the production zone, as is the case in many horizontal wells and also in some vertical wells. FIGS. 2A and 2B illustrate an example cross-sectional flow path of liquid and gaseous components recovered from the production zone for improved separation prior to entry into the pump 208. Solid arrows (e.g., arrow 214) represent mostly liquid fluid streams, while dotted arrows (e.g., arrow 218) represent mostly gaseous fluid streams in FIGS. 2A and 2B.

Figure 3:
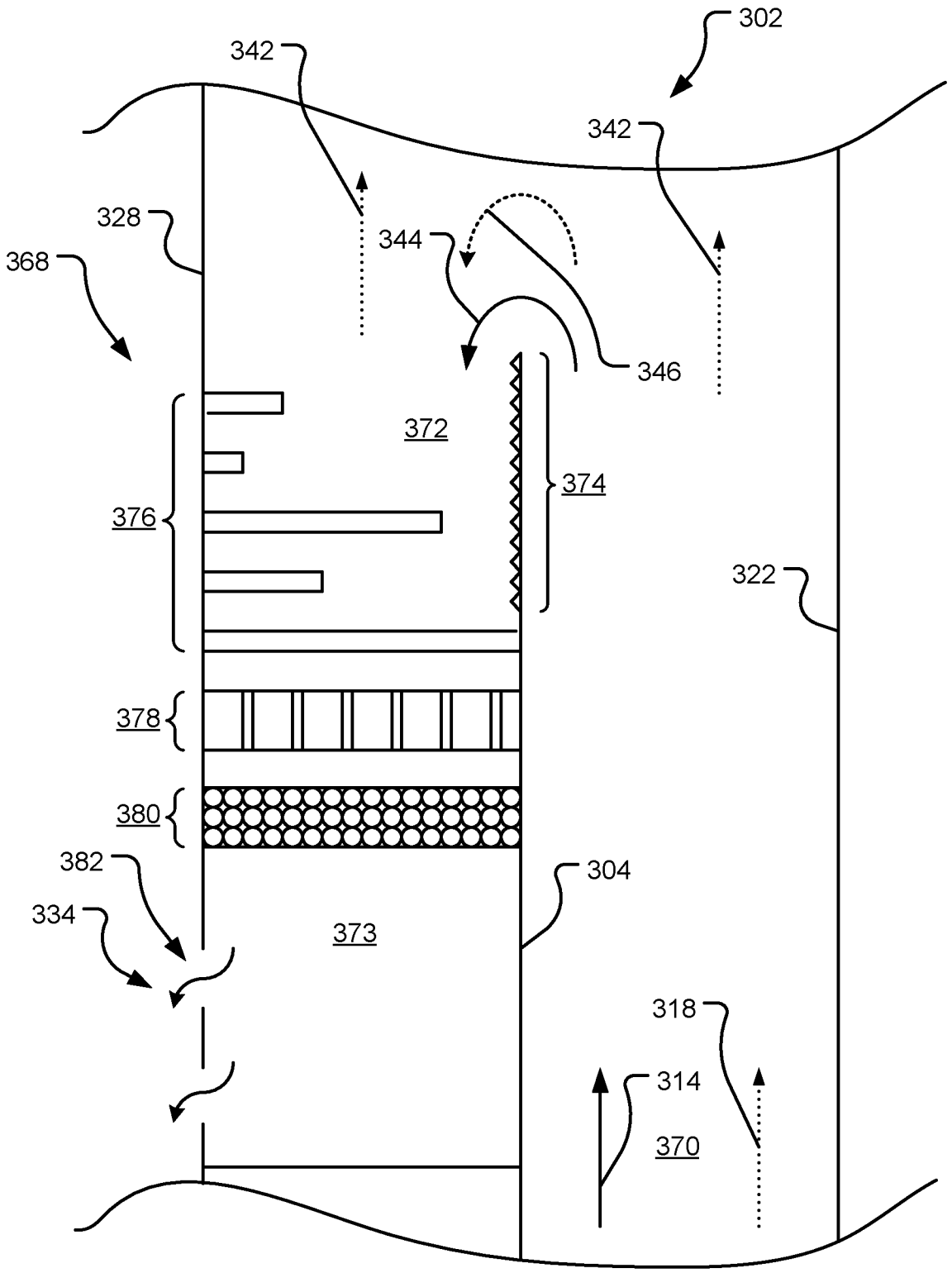
FIG. 3 illustrates mechanical separation structures for facilitating separation of gaseous components from liquid components within a mixed fluid stream.

A combined fluid stream of liquid and gaseous components (e.g., oil, water, and natural gas) of the fluid recovered from the production zone is pumped (and perhaps pushed via natural pressure of the production zone) upward between the casing 222 and the separator sleeve 204, as illustrated by arrows 214, 218. A bottom end of the separator sleeve 204 is welded or otherwise sealed to an outside surface at the bottom of the tubing 228, which is also sealed at its bottom with a bullplug 238 or other sealing structure. A top end of the separator sleeve 204 is left open to the first annulus between the casing 222 and the tubing 228. Additional details regarding the separator sleeve 204, including example mechanical separation structures are depicted in FIG. 3 and described in detail below.

The pump 208 includes two ball check valves: a stationary valve 258 at the bottom of the pump 208 (also referred to herein as a standing valve) and a traveling valve 260 on piston 262 connected to the bottom of sucker rod 220 that travels up and down as the sucker rod 220 reciprocates. Production fluid enters the casing 222 at the bottom of the borehole (not shown) through perforations that have been made through the casing 222 and surrounding cement (also not shown). As discussed above with reference to FIG. 1, the casing 222 is a metal pipe that runs the length of an associated well, which has cement placed between it and the earth. The tubing 228, the pump 208, and the sucker rod 220 are all oriented inside the casing 222. In many implementations, the casing 222, the tubing 228, and the pump 208 are oriented concentrically about the sucker rod 220 and a center of the borehole.

During the upstroke of the pump 208 illustrated in FIG. 2A, a reciprocating vertical motion of the sucker rod 220 is oriented upward, as illustrated by arrow 234. In this motion, the traveling valve 260 is closed and the standing valve 258 is open (due to a drop in pressure in pump barrel 264). Consequently, the pump barrel 264 fills with fluid as illustrated by arrow 236 as the piston 262 lifts the previous contents of the pump barrel 264 upwards, as illustrated by arrow 240.

As discussed above, both liquid components and gaseous components (e.g., oil, water, and natural gas) are often mixed together within a combined fluid recovered from the production zone. However, the pump 208 operates most efficiently with an uncompressible fluid, which the liquid components at the pressures envisioned herein are substantially, while the gaseous components at the pressures envisioned herein are substantially not. As a result, the greater gaseous components as a percentage of the total fluid that enters the pump 208 reduces its pumping efficiency up to a point where it ceases to function (referred to herein as gas locking or gas interference), where insufficient pressure builds up in the pump barrel 264 to open the valves 258, 260 (due to compression of the gas) and little or nothing is pumped upward within the tubing 228.

To preclude or reduce the occurrence of gas locking and/or improve pumping efficiency, the presently disclosed downhole gas separator 202 with the separator sleeve 204 is intended to substantially separate the gaseous components from the liquid components of the fluid generated from the production zone prior to entering the pump 208, as discussed in detail below. Generally speaking, as gas-laden fluid enters the well bore through the perforations, the gaseous components bubble up the first annulus, as illustrated by arrow 242, while the liquid components move down to the standing valve 258 inlet at the bottom of dip tube 248. Once at the surface, the gaseous components are collected at the manifold from the first annulus and the liquid components are collected at the manifold from the tubing 228.

The combined stream of liquid and gaseous components has a first diversion point at the separator sleeve 204 opening, where the gaseous components are biased to continue moving upwards due to their lower relative fluid density and upward momentum, as illustrated by dotted arrow 244, while the liquid components are biased to make a u-turn (i.e., a 180-degree turn) and continue within a second annulus between the separator sleeve 204 and the tubing 228 due to the pumping pressure caused by the pump 208, as illustrated by solid arrow 246.

The fluid stream flowing downward between the separator sleeve 204 and the tubing 228 will still include some of the gaseous components mixed therein as the fluid stream approaches a second diversion point at a series of openings in the tubing 228 inside of the separator sleeve 204. The gaseous components are still biased to move against the overall downward fluid flow due to their lower relative fluid density, while the liquid components are biased to make an s-turn (i.e., a series of two opposite 90-degree turns) and continue within a third annulus between the tubing 228 and the dip tube 248 still due to the pumping pressure caused by the pump 208, as illustrated by solid arrows 250.

The dip tube 248 has an open end extending below the openings in the tubing 228 and serves as an inlet for the pump 208. The fluid stream flowing downward between the tubing 228 and the dip tube 248 will still include some of the gaseous components mixed therein as the fluid stream approaches a third diversion point at the open end of the dip tube 248. The gaseous components are still biased to move against the overall downward fluid flow due to their lower relative fluid density, while the liquid components are biased to make a second u-turn and continue into the dip tube 248 due to the pumping pressure caused by the pump 208, as illustrated by solid arrow 252.

As the fluid drawn into the dip tube 248 has had three separate points of diversion and associated opportunities for the gaseous components to separate from the liquid components of the initial combined stream, the fluid drawn into the dip tube 248 is substantially comprised of the liquid components as it enters the pump 208. Further, one or more of the separator sleeve 204, the tubing 228, and the dip tube 248 may include structures to mechanically facilitate separation of the gaseous components from the liquid components (not shown, see e.g., separation structures 368 of FIG. 3). In various implementations, the dip tube 248 is at least 2 inches in diameter (e.g., 2.375 inches), which can yield reduced friction loss on the fluid drawn into the dip tube 248 as compared to smaller dip tubes (e.g., 1.5 inches or less).

FIG. 2B illustrates the example downhole gas separator 202 of FIG. 2A during a downstroke of the reciprocating piston pump 208. As the reciprocating piston pump 208 by its very nature has a discrete and separate upstroke and downstroke, during the downstroke depicted in FIG. 2B, the gaseous components may have an additional opportunity to separate from the liquid components of the combined stream and rise due to their lower respective densities as the downward flow of the combined stream caused by the pump 208 subsides.

More specifically, during the downstroke of the pump 208 illustrated in FIG. 2B, the reciprocating vertical motion of the sucker rod 220 is oriented downward, as illustrated by arrow 254. In this motion, the traveling valve 260 opens and the standing valve 258 closes (due to an increase in pressure in the pump barrel 264). The traveling valve 260 drops through the fluid in the pump barrel 264 (which had been previously sucked in during the upstroke illustrated in FIG. 2A), as illustrated by arrows 256, 266. The piston 262 then reaches the end of its stroke and begins its path upwards again, repeating the upstroke illustrated in FIG. 2A.

While the downward pumping pressure on the combined fluid stream has subsided during the downstroke of the pump 208, the gaseous components throughout the entire system upstream of the dip tube 248 remain biased to continue moving upwards due to their lower relative fluid density and upward momentum, as illustrated by all dotted arrows of FIG. 2B. The liquid components of the combined fluid stream remain stationary, or even move downward to displace the upward moving gaseous components.

The wellbore and depicted structures therein are generally concentric about the sucker rod 220, thus the structures illustrated FIGS. 2A & 2B are generally mirrored about the sucker rod 220. The disclosed u-turns and s-turns and associated turn degrees are approximate and illustrative of overall changes in fluid direction over a variable distance, not an exact directional change of a specific fluid quantity at any particular point.

FIG. 3 illustrates mechanical separation structures 368 for facilitating separation of gaseous components from liquid components within a mixed fluid stream 370. A reciprocating piston pump (not shown, see e.g., pump 208) is secured within casing 322 that extends between a subterranean production zone (not shown, see e.g., production zone 111 of FIG. 1) and a manifold (not shown, see e.g., manifold 132 of FIG. 1) at the surface. An output of the pump is connected back to the surface with tubing 328. An output of the casing 222 within a depicted first annulus between the casing 322 and the tubing 328 is also connected back to the surface. For illustration purposes, only a section of the casing 322 and the tubing 328 is depicted in FIG. 3 and extends in both longitudinal directions beyond the view of FIG. 3 between the subterranean production zone and the manifold.

As discussed above, efficient and complete separation of liquid and gaseous components of fluid recovered from the production zone can be difficult, particularly when the pump is oriented above the production zone, as is the case in many horizontal wells and also in some vertical wells. FIG. 3 illustrates an example cross-sectional flow path of liquid and gaseous components recovered from the production zone for improved separation prior to entry into the pump. Solid arrows (e.g., arrow 314) represent mostly liquid fluid streams, while dotted arrows (e.g., arrow 318) represent mostly gaseous fluid streams in FIG. 3.

The combined (or mixed) fluid stream 370 of liquid and gaseous components (e.g., oil, water, and natural gas) of the fluid recovered from the production zone is pumped (and perhaps pushed via natural pressure of the production zone) upward between the casing 322 and the separator sleeve 304, as illustrated by arrows 314, 318. A bottom end of the separator sleeve 304 is welded or otherwise sealed to a bottom of the tubing 328, which is also sealed at its bottom. A top end of the separator sleeve 304 is left open to the first annulus between the casing 322 and the tubing 328, which is also referred to herein as an inlet.

The combined (or mixed) fluid stream 370 of production fluid enters the casing 322 at the bottom of the borehole (not shown) through perforations that have been made through the casing 322 and surrounding cement (also not shown). As discussed above with reference to FIG. 1, the casing 322 is a metal pipe that runs the length of an associated well, which has cement placed between it and the earth. The tubing 328, the separator sleeve 304, and the pump are all oriented inside the casing 322. In many implementations, the casing 322, the separator sleeve 304, the tubing 328, and the pump are oriented concentrically about a center of the borehole.

To preclude or reduce the occurrence of gas locking and/or improve pumping efficiency for the pump, the presently disclosed downhole gas separator 302 with the separator sleeve 304 is intended to substantially separate the gaseous components from the liquid components of the fluid generated from the production zone prior to entering the pump, as discussed in detail below. Generally speaking, as gas-laden fluid enters the well bore through the perforations, the gaseous components bubble up the first annulus, as illustrated by arrows 342, while the liquid components move down to the tubing inlet (not shown), as illustrated by arrows 334. Once at the surface, the gaseous components are collected at the manifold connected to the first annulus and the liquid components are collected at the manifold connected to the tubing 328.

The combined (or mixed) fluid stream 370 of production fluid has a first diversion point at the separator sleeve 304 opening (or inlet), where the gaseous components are biased to continue moving upwards due to their lower relative fluid density and upward momentum, as illustrated by dotted arrows 342, while the liquid components are biased to make a u-turn (i.e., a 180-degree turn) and continue within a second annulus between the separator sleeve 304 and the tubing 328 due to the pumping pressure caused by the pump, as illustrated by solid arrow 344. Some of the gaseous components also make the u-turn mixed in with the liquid components, as illustrated by dotted arrow 346.

The fluid stream flowing downward between the separator sleeve 304 and the tubing 328 will still include some of the gaseous components mixed therein as the fluid stream approaches a second diversion point at a series of openings 382 in the tubing 328 inside of the separator sleeve 304. Between the first diversion point and the second diversion point and within the second annulus between the separator sleeve 304 and the tubing 328, the downhole gas separator 302 includes one or more separation structures 368 to facilitate separation of gas from liquid within the mixed fluid stream 370 flowing downward between the separator sleeve 304 and the tubing 328. Each of the separation structures 368 act to increase turbulent fluid flow, add a more convoluted fluid path, and/or add structures that mechanically separate gaseous components from liquid components within the mixed fluid stream 372.

Surface contouring 374 is applied to the interior surface of the separator sleeve 304. The surface contouring causes turbulent fluid flow adjacent to the separator sleeve 304 wall, thus facilitating separation of gaseous components from liquid components within the mixed fluid stream 372. In other implementations, other surface contouring may be applied to the exterior surface of the tubing 328 in addition to or in lieu of the depicted surface contouring 374. In various implementations, the surface contouring may include knurling, threading, blasting, etching, and so on.

A series of baffles 376 are applied to the exterior surface of the tubing 328. The baffles 376 cause turbulent fluid flow through a more convoluted flow path around and through the baffles 376, thus facilitating separation of gaseous components from liquid components within the mixed fluid stream 372. In other implementations, other baffles may be applied to the interior surface of the separator sleeve 304 in addition to or in lieu of the depicted baffles 376.

The baffles 376 are generally arranged radially about the borehole and may extend partially and/or fully across the second annulus between the tubing 328 and the separator sleeve 304. Further, the baffles 376 may be arranged as vanes to induce a turbulent rotational flow within the second annulus (also referred to herein as a vortex effect). The individual baffles may have a variety of cross-sectional shapes (e.g., a round cross section, such as a pin or a screw or a flat cross-section, such as bar stock to form a vane), for example. The individual baffles may be arranged radially and oriented at a variety of radial angles with reference to the fluid flow direction (e.g., 0, 30, 60, or 90 degrees). Finally, the baffles that extend fully across the second annulus between the tubing 328 and the separator sleeve 304 may further serve to secure the separator sleeve 304 to the tubing 328. In some implementations, one or both of the surface contouring 374 and the baffles (or vanes) 376 are used and may occupy similar or distinct volumes of the second annulus, one or both of which may be approximately 10 feet in length. Any of the disclosed baffles 376, vanes, and the like may be referred to herein as mechanical diverters.

A screen 378 also occupies the second annulus between the tubing 328 and the separator sleeve 304. The screen 378 causes turbulent fluid flow through a more convoluted flow path through individual holes or pores in the screen, thus facilitating separation of gaseous components from liquid components within the mixed fluid stream 372. Impingement with the screen 378 also facilitates separation of the gaseous components from the liquid components. In various implementations, the screen 378 may be formed from wire mesh, drilled plate(s), micro-fluidic porous structures, and so on.

A media section 380 also occupies the second annulus between the tubing 328 and the separator sleeve 304. The media section 380 causes turbulent fluid flow through a more convoluted flow path through individual pieces of media, thus facilitating separation of gaseous components from liquid components within the mixed fluid stream 372. In various implementations, the media section 380 may be formed from a mass of round, jagged, or other consistently or inconsistently shaped small pieces of media (e.g., steel ball bearings) contained within wire mesh or drilled plate(s). In some implementations, one or both of the screen 378 and the media section 380 occupy an approximately 4-foot length of the second annulus.

While FIG. 3 illustrates four distinct separation structures 368 (the surface contouring 374, the baffles 376, the screen 378, and the media section 380), greater or fewer types of separation structures 368 may be used in other downhole gas separators. The size and placement of the separation structures 368 within the downhole gas separator 302 of FIG. 3 is for illustration purposes only.

In some implementations, an additional volume 373 of the second annulus is provided without any separation structures 368, which facilitates separation of gaseous components from liquid components solely by gravity separation. This volume 373 may be approximately 12 feet in length and may follow below the separation structures 368.

The fluid stream flowing downward between the separator sleeve 304 and the tubing 328 will still include some of the gaseous components mixed therein as the fluid stream approaches a second diversion point at a series of openings 382 in the tubing 328 inside of the separator sleeve 304. The gaseous components are still biased to move against the overall downward fluid flow due to their lower relative fluid density, while the liquid components are biased to make an s-turn (i.e., a series of two opposite 90-degree turns) and continue within a third annulus between the tubing 228 and the dip tube (not shown) still due to the pumping pressure caused by the pump, as illustrated by solid arrows 334. The openings 382 in the tubing 328 may include one or both of round holes and elongated slots. In one example implementation, the openings 382 are three 0.5×5.0 inch slots equally spaced about the tubing 328 and running lengthwise down the tubing 328.

Figure 4:
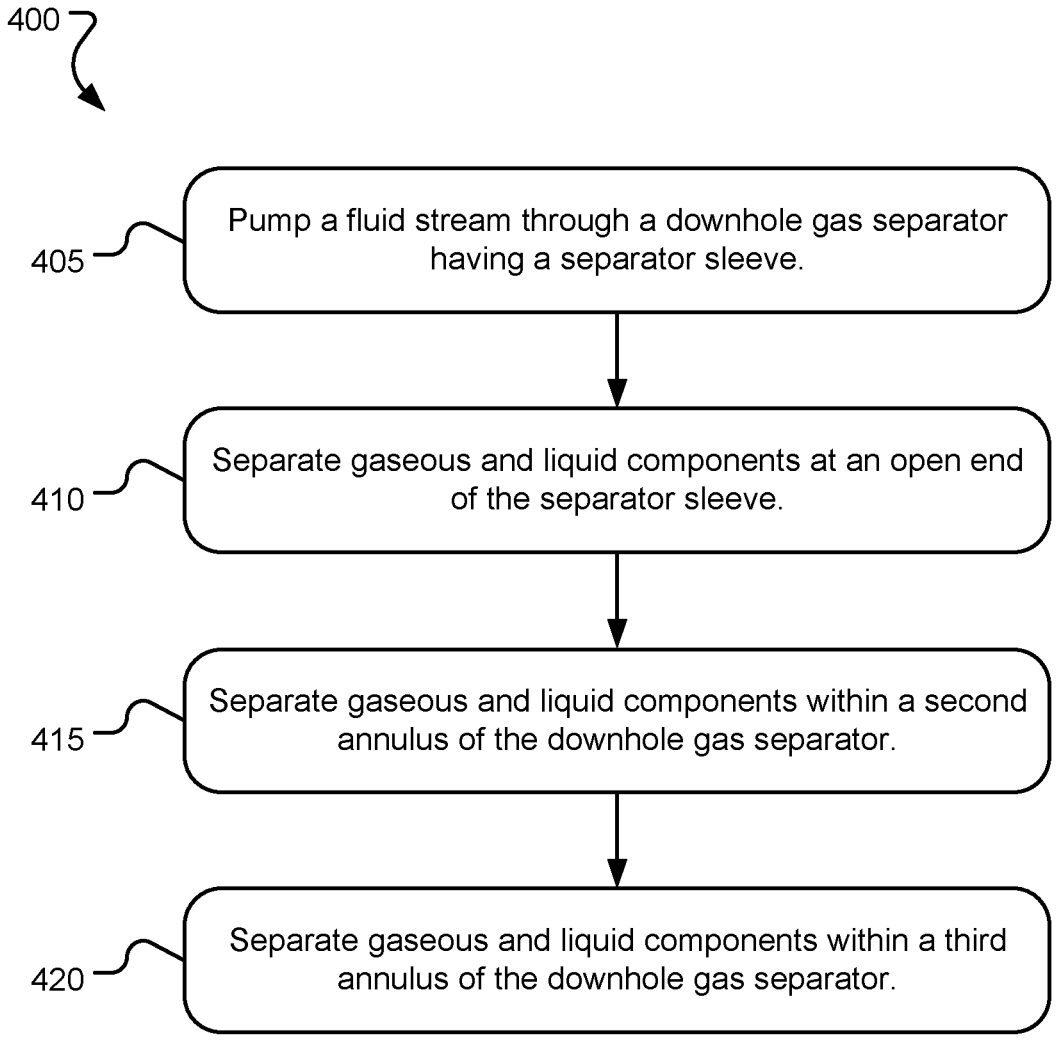
FIG. 4 illustrates example operations for operating a downhole gas separator with a separator sleeve.

FIG. 4 illustrates example operations (or method) 400 for operating a downhole gas separator with a separator sleeve. A pumping operation 405 pumps a fluid stream through the downhole gas separator. The downhole gas separator includes a first annulus between a casing and a separator sleeve, a second annulus between the separator sleeve and a tubing section, and a third annulus between the tubing section and a dip tube. The dip tube extends from a tubing inlet (via a mechanical seating nipple) to an open end. The tubing section extends around the dip tube and has a closed end below the open end of the dip tube and perforations above the open end of the dip tube. The separator sleeve extends around the perforated tubing section and has a closed end below the perforations in the tubing section and an open end above the perforations in the tubing section. The casing extends around the tubing section.

A first separation operation 410 separates gaseous and liquid components at a first diversion point of the pumped fluid stream at the open end of the separator sleeve. The gaseous components are biased to continue moving upwards due to their lower relative fluid density and upward momentum, while the liquid components are biased to make a u-turn and continue within a second annulus between the separator sleeve and the tubing due to the pumping pressure caused by the pump.

A second separation operation 415 separates gaseous and liquid components within a second annulus between the separator sleeve and the tubing section. The gaseous components are still biased to move against the overall downward fluid flow due to their lower relative fluid density, while the liquid components are biased to make an s-turn and continue within a third annulus between the tubing and a dip tube still due to the pumping pressure caused by the pump. In various implementations, the second annulus may include one or more separation structures as described above in detail with reference to separation structures 368 of FIG. 3 to facilitate separation.

A third separation operation 420 separates gaseous and liquid components within a third annulus between the tubing section and the dip tube. The gaseous components are still biased to move against the overall downward fluid flow due to their lower relative fluid density, while the liquid components are biased to make a second u-turn and continue into the dip tube due to the pumping pressure caused by the pump. In various implementations, the third annulus may include one or more separation structures as described above in detail with reference to separation structures 368 of FIG. 3 to facilitate separation. The multiple separation operation 410, 415, 420 and corresponding separate points of diversion and associated opportunities for the gaseous components to separate from the liquid components is also referred to as multi-stage separation.

All dimensions herein are approximate, which is generally considered to be +/−10 percent in the context of this patent application, unless otherwise provided. Use of the term "substantially" is also understood to mean within +/−10 percent in the context of this patent application, unless otherwise provided. Well conditions in each unique application will dictate the design length and other dimensions of the separator sleeve and related components of the downhole gas separator. The logical operations making up the embodiments of the invention described herein are referred to variously as operations, steps, objects, or modules. Furthermore, it should be understood that logical operations may be performed in any order, unless explicitly claimed otherwise or a specific order is inherently necessitated by the claim language.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A downhole gas separator comprising:

a pump;

a dip tube extending from a dip tube inlet to the pump;

a tubing section extending around the dip tube, the tubing section having a closed end below the dip tube inlet and openings above the dip tube inlet; and a separator sleeve extending around the tubing section, the separator sleeve having a closed end below the openings in the tubing section and an open end above the openings in the tubing section;

a series of mechanical diverters oriented within a second annulus between the separator sleeve and the tubing section; and one or more of a screen, a media section, and surface contouring also oriented within the second annulus between the separator sleeve and the tubing section.

2. The downhole gas separator of claim 1, wherein the pump is oriented within the tubing section and fluidly connected to the dip tube at the dip tube inlet, the pump to draw a fluid stream through a first annulus between a casing and the separator sleeve, a second annulus between the separator sleeve and the tubing section, and a third annulus between the tubing section and the dip tube.

3. The downhole gas separator of claim 2, wherein a liquid component of the fluid stream makes a first u-turn at the open end of the separator sleeve, an s-turn at the openings in the tubing section, and second u-turn at the dip tube inlet.

4. The downhole gas separator of claim 2, wherein a gaseous component of the fluid stream continues upwards at the open end of the separator sleeve, within the second annulus between the separator sleeve and the tubing section, and within the third annulus between the tubing section and the dip tube.

5. The downhole gas separator of claim 1, wherein the dip tube, the tubing section, and the separator sleeve are substantially concentric.

6. The downhole gas separator of claim 1, wherein the series of mechanical diverters cause turbulent fluid flow through the second annulus between the separator sleeve and the tubing section.

7. The downhole gas separator of claim 1, wherein the series of mechanical diverters extend between the separator sleeve and the tubing section further securing the separator sleeve to the tubing section.

8. The downhole gas separator of claim 1, wherein the series of mechanical diverters are angled to induce a turbulent rotational flow within the second annulus between the separator sleeve and the tubing section.

9. The downhole gas separator of claim 1, wherein the series of mechanical diverters are further oriented between the openings in the tubing section and the open end of the separator sleeve.

10. The downhole gas separator of claim 1, wherein one or more of the screen, the media section, and the surface contouring are further oriented between the openings in the tubing section and the open end of the separator sleeve.

11. The downhole gas separator of claim 1, wherein the surface contouring is applied to one or both of an interior surface of the separator sleeve and an exterior surface of the tubing section within the second annulus.

12. The downhole gas separator of claim 1, wherein the closed end of the separator sleeve is sealed and secured to an outside surface of the tubing section.

13. The downhole gas separator of claim 1, wherein the openings in the tubing section include one or both of round holes and elongated slots.

14. A method of operating a downhole gas separator comprising:

pumping a production fluid stream through a first annulus between a casing and a separator sleeve, a second annulus between the separator sleeve and a tubing section, and a third annulus between the tubing section and a dip tube using a pump, wherein the dip tube extends from a dip tube inlet to the pump;

the tubing section extends around the dip tube, the tubing section having a closed end below the dip tube inlet and openings above the dip tube inlet;

the separator sleeve extends around the tubing section, the separator sleeve having a closed end below the openings in the tubing section and an open end above the openings in the tubing section, and wherein a series of mechanical diverters are oriented within the second annulus between the separator sleeve and the tubing section, and wherein one or more of a screen, a media section, and surface contouring are further oriented within the second annulus between the separator sleeve and the tubing section; and the casing extends around the tubing section.

15. The method of claim 14, further comprising:

separating gas and liquid components at the open end of the separator sleeve.

16. The method of claim 15, further comprising:

separating gas and liquid components within the second annulus between the separator sleeve and the tubing section.

17. The method of claim 16, further comprising:

separating gas and liquid components within the third annulus between the tubing section and the dip tube.

18. The method of claim 14, wherein a liquid component of the fluid stream makes a first u-turn at the open end of the separator sleeve, an s-turn at the openings in the tubing section, and second u-turn at the dip tube inlet.

19. The method of claim 14, wherein a gaseous component of the fluid stream continues upwards at the open end of the separator sleeve, within the second annulus between the separator sleeve and the tubing section, and within the third annulus between the tubing section and the dip tube.

20. An oil well comprising:

a casing including a perforated area through which a multi-phase fluid enters the casing;

a sucker-rod pump; and a downhole gas separator secured within the casing above the perforated area, the downhole gas separator including:

a dip tube extending from a dip tube inlet to the sucker-rod pump;

a tubing section extending around the dip tube, the tubing section having a closed end below the dip tube inlet and openings above the dip tube inlet;

a separator sleeve extending around the tubing section, the separator sleeve having a closed end below the openings in the tubing section and an open end above the openings in the tubing section;

a series of mechanical diverters oriented within a second annulus between the separator sleeve and the tubing section; and one or more of a screen, a media section, and surface contouring also oriented within the second annulus between the separator sleeve and the tubing section, wherein the sucker-rod pump is to draw a fluid stream from the multi-phase fluid through a first annulus between the casing and the separator sleeve, the second annulus between the separator sleeve and the tubing section, and a third annulus between the tubing section and the dip tube and separate gas and liquid components of the fluid stream within each of the first annulus, the second annulus, and the third annulus.

* * * * *